US005822277A

United States Patent [19]

Van Amersfoort et al.

[11] Patent Number: 5,822,277

[45] Date of Patent: Oct. 13, 1998

[54] LONG PERIOD PENDULUM APPARATUS

[76] Inventors: Jan Van Amersfoort, deceased, late of Pasadena, Calif.; by Theodora Johanna Van Amersfoort, legal representative, 1111 Meford Rd., Pasadena, Calif. 91107

[21] Appl. No.: 826,103

[22] Filed: Mar. 24, 1997

[51] Int. Cl.[6] ..... G04B 19/00; G04B 15/00; G04B 17/02

[52] U.S. Cl. ..... 368/76; 368/134; 368/165; 368/179

[58] Field of Search ..... 368/10, 76, 134–137, 368/165–166, 179–182, 223, 228

[56] References Cited

U.S. PATENT DOCUMENTS 4,121,416 10/1978 Niemczyk ..... 368/88
4,196,579 4/1980 Schaefer ..... 368/181
4,378,166 3/1983 Itami et al. ..... 368/134
4,712,925 12/1987 Beebe ..... 368/179
4,723,232 2/1988 Beebe ..... 368/76
4,723,233 2/1988 Beebe ..... 368/26

*Primary Examiner*—Vit W. Miska
*Attorney, Agent, or Firm*—George J. Netter

[57] ABSTRACT

A pendulum stem (16) not more than 4 inches in length has one end portion swingably connected to a pivot arrangement (18) and a concentrated mass (22) slidably located on the other end portion. Permanent magnets (56,58) secured to the mass (22) move past a pair of wire coils (60,62) during swinging movement of the stem and mass to induce a signal in the one coil (60). The signal actuates a circuit (66) to form a pulse that is applied to the other coil (62) at an appropriate later time to create a magnetic pulse driving the mass (22) and stem (16) along its swing path. The described pendulum drive applied to a miniature clock provides a slow-swinging pendulum having a period closely approximating that of a grandfather clock many feet in height.

7 Claims, 2 Drawing Sheets

LONG PERIOD PENDULUM APPARATUS

BACKGROUND

1. Background of the Invention

The present invention relates generally to a pendulum, and, more particularly, to apparatus for oscillating pendulum and effecting a substantially longer period of oscillation than would be expected from the pendulum dimensional characteristics alone.

2. Description of Related Art

The physical characteristics that typically describe the rate at which a pendulum will swing or the period of the pendulum (i.e., the time required for the pendulum to swing from one extreme to its other extreme and return to its starting point) is determined for a simple pendulum essentially by the length of the pendulum arm or stem. More particularly, in the case of a so-called simple pendulum, the pendulum length is defined as the distance from the pivot point for the one end of the pendulum stem to its center of mass typically a concentrated mass ("blob") of material located at some distance along the stem from the pivot point. In this case, the longer the pendulum, the longer the period of oscillation.

It is desirable under some circumstances to be able to increase the period of a pendulum without changing its stem length. Although other situations may be found in which pendulum period of oscillation modification is desirable, it will be described herein particularly in regard to a pendulum which is incorporated into a miniaturized so-called grandfather clock.

Miniaturization has as its primary aim the reduction in size of an item while giving the appearance of being otherwise an accurate duplication of the full-sized item so as to be a replica in all other respects, with size being the sole change. In the case of a grandfather clock, the miniaturization requires, of course, a reduction in length of the pendulum stem that is typically found in such clocks and is so located that the oscillating pendulum can be readily viewed through a transparent partition in the front of the clock. However, in this situation although the appearance and construction can be readily made substantially precisely identical to a full sized clock which may be as large as 6–10 feet in height. However, when the pendulum stem is reduced to a matter of several inches, its physical characteristics do not permit it to have a normal period (swinging to and fro) associated with the grandfather clock full size. Thus, for example, on reduction and utilizing merely the weight of a blob at the end of a pendulum several inches in length, it will be found to swing at a relatively rapid rate which totally destroys the desired appearance of a full-sized grandfather clock where the pendulum would swing at a very low rate having a period in excess of one second.

SUMMARY OF THE INVENTION

It is therefore a primary aim and object of the present invention to provide a pendulum drive apparatus producing pendulum oscillation having a substantially lengthened period beyond that which would be predicted from its size alone.

Another object of the invention is the provision of pendulum apparatus as in the preceding object in which the period of a pendulum having a stem not exceeding about 4 inches in length exceeds one (1) second.

In accordance with the practice of the present invention there is provided a pendulum stem which has spaced from one end a pivot mounting such that the stem can oscillate along a predetermined arcuate path with respect to the pivot. Adjacent the stem other end there is provided a pendulum weight ("blob") having first and second permanent magnets located respectively at each side of the stem. The pendulum stem and pivot are mounted within a miniaturized "grandfather" clock enclosure with the weighted end hanging along a gravity path below the pivot point and the clock enclosure having sufficient lateral dimensions to enable the pendulum arm to swing freely along the predetermined arcuate path.

First and second coils of wire are fixedly arranged in a slightly spaced coaxial mounting behind the pendulum stem and substantially directly opposite the pendulum weight or blob at a point along the predetermined oscillation path. The first coil on the pendulum magnet moving therepast generates an electrical input signal for an electrical pulse generating circuit with the second connected as an output of the circuit to induce movement of the pendulum weight and stem.

In operation, on the pendulum weight with two magnets passing by the first coil, there is induced therein a signal which energizes the electrical circuit and at some predetermined time thereafter determined by the circuit components, a magnetic force is generated by the second winding impulsing the pendulum magnet and thus the blob to movement in a direction along the predetermined path to swing about the pivot point. A counterweight above the pivot point is mounted onto the upper end portion of the stem and the combination of the described electrical circuit action and the counter-weight produces a very slow oscillatory movement of the pendulum very much like that which is observed when the pendulum of a full-size grandfather clock is viewed during oscillation.

BRIEF DESCRIPTION OF THE DRAWING

Other objects and features of the inventions will become more readily apparent upon reference to the detailed description and the attached drawings, in which.

DESCRIPTION OF A PREFERRED EMBODIMENT

Figure 1:
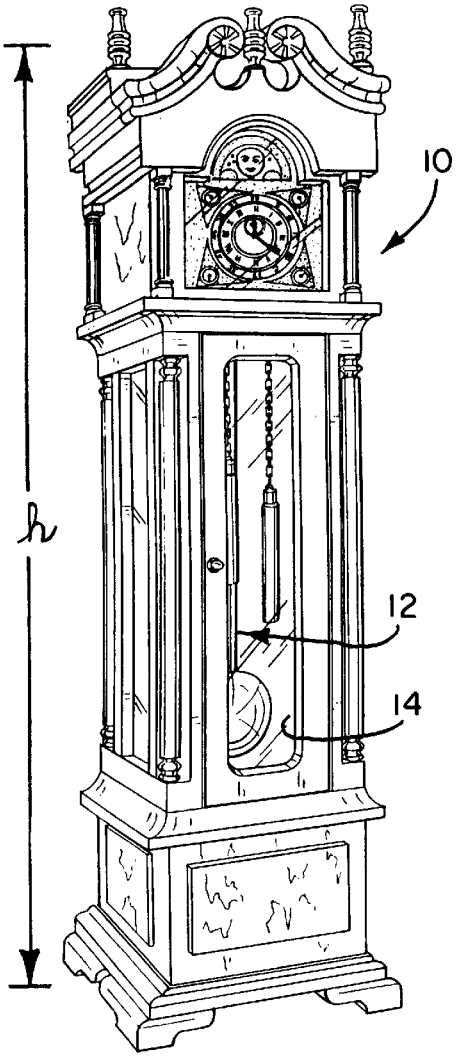
FIG. 1 is front perspective view of a miniaturized grandfather clock modified in accordance with the present invention.

With reference now to the drawings and particularly FIG. 1, there is shown a miniature grandfather style clock enumerated generally as 10 which for purposes important to the function and advantages of the present invention includes a pendulum assembly 12 the oscillation of which is visible through a transparent front panel 14. By miniature, reference is essentially meant to a clock apparatus having an overall height h of about six (6) inches with a clock pendulum arm or stem of approximately four (4) inches. A conventional grandfather clock, on the other hand, could have an overall height on an average exceeding six (6) feet, which establishes a miniaturization ratio of 1/18. Such miniature clocks have attracted considerable attention among hobbyists and those interested in collectibles generally.

As will be more particularly shown, the present invention provides apparatus for effecting oscillation of the pendulum assembly 12 at a period (i.e., oscillation back and forth time) that exceeds one second which is commensurate with the oscillatory period observed on a conventional sized grandfather clock. Accordingly, through the practice of the present invention the miniaturized clock assembly provides a pendulum assembly that oscillates in a manner enhancing appearance authenticity of the miniaturized version as compared with a full-sized clock.

Figure 2:
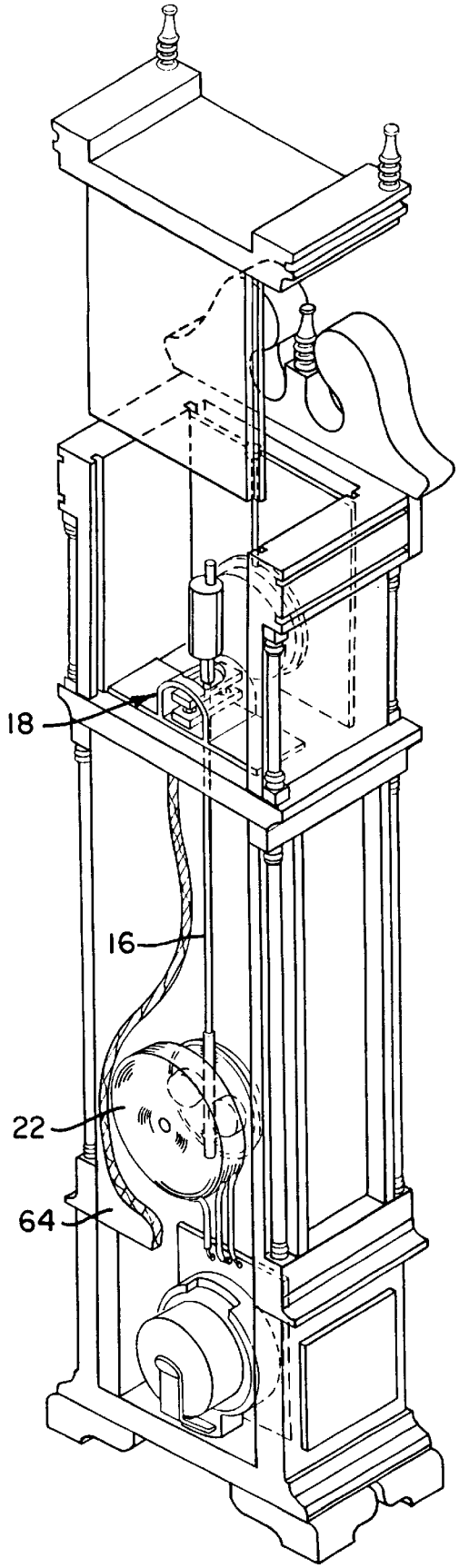
FIG. 2 is a further perspective partially sectional view of the invention.
Figure 3:
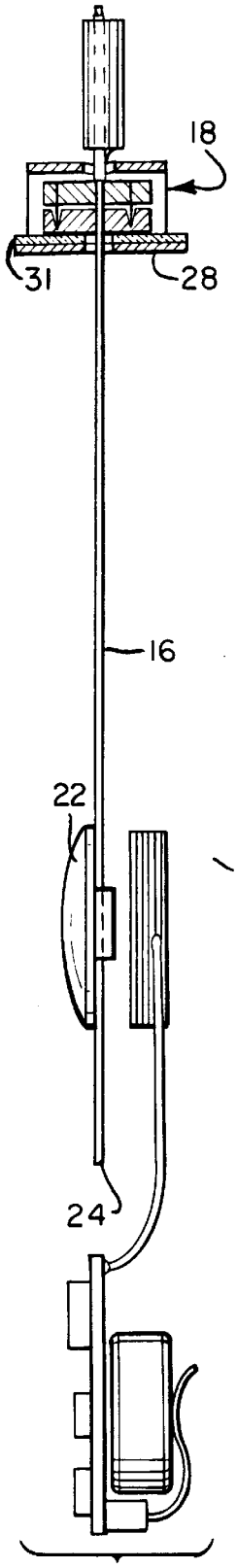
FIG. 3 is a side elevational, partially sectional view of the pendulum apparatus of the present invention.
Figure 4:
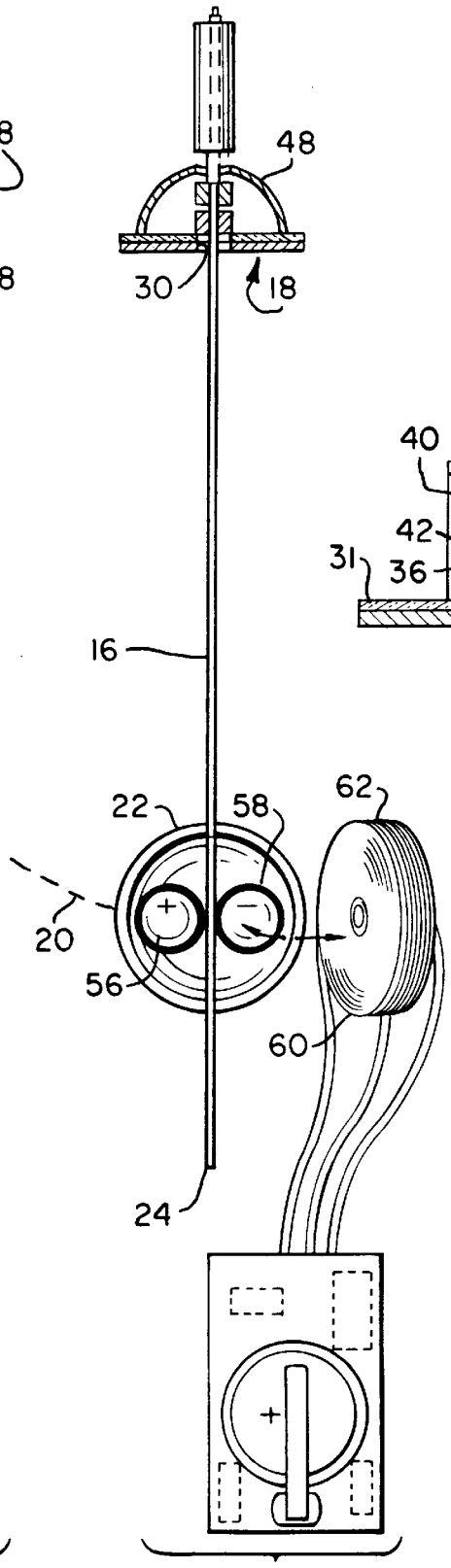
FIG. 4 is a further elevational, sectional view taken at 90-degrees to the view of FIG. 3.
Figure 5:
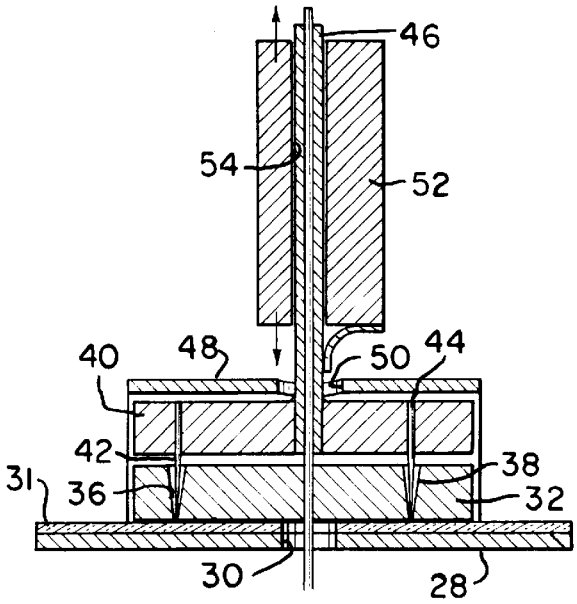
FIG. 5 is an enlarged, partially fragmentary, sectional view of the pivot end of the pendulum.

For the ensuing detailed description of the pendulum apparatus of this invention reference is made simultaneously to FIGS. 2–4 of the drawing. The pendulum assembly 12 includes a stem or arm 16 having an upper end portion that is mounted on a pivot arrangement 18 for oscillatory motion along a predetermined direction 20 lying substantially in a single plane. A weight or blob 22 is slidingly and securingly positioned on what is the lower end portion 24 of the stem and can be repositioned at any desirable location along the stem length. The blob engages the stem with sufficient frictional contact that when the blob is positioned at some desired location, the frictional force retains it in position until it is affirmatively readjusted to a new one.

The pivot arrangement 18 includes a generally flat rectangular metal base at 28 having a slotted opening 30 therein through which the pendulum stem 16 extends and can freely oscillate within the opening along direction 20 without contacting the edge walls defining the slot. A glass plate 31 having a slotted opening therein of a size and geometry commensurate to opening 30 and aligned therewith rests on the upper surface of the metal base 28. A first elongated generally parallelepiped metal body 32 is restingly positioned on the upper surface of the glass base or plate 31 and has a slot 36 therein which aligns with the slotted opening 30. Opening outwardly on the upper surface of the body 32 are shallow first and second conical openings 36 and 38 extending downwardly partway into the plate body and bottoming into the small end of the cone.

A second metal body 40 of dimensions and geometry substantially identical to those of the first body 32 is held above the first body by a pair of needles 42 and 44 which are affixed within the body 40 and extend downwardly therefrom to be received within the openings 36 and 38, respectively.

A hollow tube 46 is fixedly located within an appropriately formed opening in the plate body 40 and extends upwardly therefrom substantially normally to the plate body major surface. The stem 16 is secured within the tube 48 so that the stem, tube and body 40 experience pivoting movement as a unit. A bracket 48 secured to the upper surface of plate 31 includes a slot 50, the transverse sides of which provide limits of pivoting movement for the pendulum stem.

An elongated, generally cylindrical counter balance 52 has a continuous opening 54 eccentrically located with respect to the cylindrical axis which is slidingly received on the upper end portion of the stem 16 and frictionally engaging the same. Adjustment of the counter balance along the stem axis modifies the period of the pendulum, whereas rotation of the counter balance eccentrically about the stem effects precise balancing within the desired pendulum swing direction plane 20.

Driving of the pendulum is generally accomplished in the manner described by giving the weight or blob 22 an impulse along its swing path once during each period. More particularly, first and second permanent magnets 56 and 58 (FIG. 4) are affixed to the rear side of the blob 22 and oriented in opposite polarities, one at each side of the stem. First and second coil windings 60 and 62 are coaxially mounted on the rear wall 64 (FIG. 2) of the clock housing so as to be slightly spaced from the blob and the magnets carried thereby when the blob swings along its path 20 of oscillatory movement. The first coil winding 60 is connected to the input of a pulse generating circuit 66 and the second coil winding 62 connects to receive the pulse output of the circuit.

In driving operation, as the magnets 56 and 58 swing past the coil winding 60 an input signal is induced therein which signal then causes a pulse to be generated by the circuit 66. In accordance with the RC characteristics of the circuit an output signal is applied to the coil winding 62 at a predetermined later time appropriately chosen so as to provide a magnetic "kick" to the pendulum blob 22 to maintain pendulum oscillation.

Figure 6:
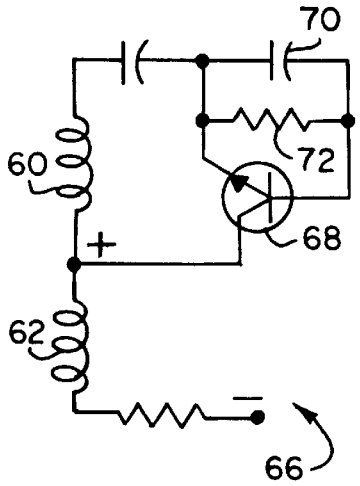
FIG. 6 is a schematic view of an electrical circuit for providing pendulum drive.

For the ensuing details of the driving pulse generating circuit 66, reference is made to FIG. 6. When a pulse of correct polarity is created in coil 60, a transistor 68 becomes conductive at a predetermined later time in accordance with the values of capacitance 70 and resistance 72 forming an RC delay circuit. At this delayed later time a current pulse passes through coil 62 which provides a magnetic kick to the second permanent magnet 58 along the path of blob oscillatory movement. The timing of this kick pulse in combination with appropriate adjustment of the counterbalance 54 along stem 16, achieves the desired slow swinging pendulum.

In a practical construction of the invention a pendulum stem having an overall length of approximately 4 inches and with the pendulum blob located at about 2.5 inches from the pendulum pivot achieved an oscillation period exceeding one (>1) second, and in this way gave the appearance of authenticity desired, namely, very slow swinging pendulum.

Although the present invention has been described in connection with a preferred embodiment, those skilled in the appertaining arts may make modifications that come within the spirit of the invention as disclosed and within the ambit of the attached claims.

What is claimed is:

1. An oscillating pendulum apparatus of selectively variable period, comprising:

pivot means;

a stem pivotally mounted to the pivot means at a point spaced from a first end of said stem;

a concentrated mass blob affixed to said stem adjacent a second end of said stem for swinging movement along a predetermined path with respect to said pivot means on pivotable motion of said stem;

a counterbalance releasably secured to said stem adjacent the first stem end;

permanent magnet means secured to said blob;

a first coil winding fixedly mounted at such spacing from the blob swing path as to enable a signal to be induced therein as the permanent magnet means moves therepast;

circuit means interconnected with the first coil winding for generating an output pulse responsive to the induced signal at a prescribed later time; and a second coil winding mounted adjacent the blob path of movement and interconnected with the circuit means for receiving the output pulse and generating a magnet field responsive to said pulse which drives the permanent magnet means and blob along said path of movement.

2. An oscillating pendulum apparatus as in claim 1, in which the first and second coil windings are coaxially mounted.

3. An oscillating pendulum apparatus as in claim 1, in which the permanent magnet means includes first and second permanent magnets mounted to the blob, one at each side of the stem, said magnets presenting respective opposite magnetic polarity surfaces toward said coil windings as said magnets move therepast.

4. A miniaturized operating grandfather style clock including an oscillating pendulum visible through a transparent front panel having an overall length from a pivot point to a lower and as short as 3 inches, comprising:

a concentrated mass blob located spaced slightly from the lower end of the pendulum, permanent magnet means affixed to a rear surface of said blob; and magnetic field pulse generating means mounted adjacent the path of pendulum oscillation for providing periodic pulses of impetus to the magnet means and blob maintaining continuous pendulum oscillation of a period exceeding one (1) second including, first and second permanent magnets carried by the blob in spaced apart relation along the oscillation path with opposite polarity arrangement;

first and second coil windings located adjacent the oscillation path such that the blob and permanent magnets move therepast at a relatively close spacing;

an electric current pulse generating circuit having an input connected to the first coil winding, an RC time delay circuit, and an output connected to the second coil winding.

5. A miniaturized operating grandfather style clock as in claim 4, in which the RC time delay circuit is such as to provide an output signal once each oscillation period with the oscillation period exceeding 1 second.

6. An authentic miniaturized clock, comprising:

a housing for upright resting location on a ground plane having a generally transparent front panel;

clockwork means in the upper part of the housing;

a pendulum stem having one end portion pivotally mounted adjacent the clockwork means for hanging disposition and pivotal oscillation along a predetermined path;

a centralized-mass blob secured to the stem adjacent the stem lower end;

magnetically responsive means affixed to said blob including first and second permanent magnets secured to the blob in spaced apart relation so that as the blob moves along the predetermined path the permanent magnets move along said path one after the other;

means located along the predetermined path of oscillation for generating magnetic pulses that cyclically drive the magnetically responsive means along said path at intervals exceeding about 1 second including first and second helically wound coils coaxially arranged such that as the first permanent magnet moves in a first direction past the first wound coil a signal is induced in said first coil which in turn produces a time delayed electric current pulse in the second wound coil driving the second magnet in the first direction, said time delay corresponding to an oscillating period exceeding about 1 second.

7. An authentic miniaturized clock as in claim 6, in which the housing is not more than about 6 inches in height.

* * * * *